US008337272B2

(12) United States Patent
Su

(10) Patent No.: US 8,337,272 B2
(45) Date of Patent: Dec. 25, 2012

(54) SIMULATED EYE FOR TOY

(75) Inventor: Xiao-Guang Su, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 530 days.

(21) Appl. No.: 12/566,687

(22) Filed: Sep. 25, 2009

(65) Prior Publication Data

US 2010/0136878 A1 Jun. 3, 2010

(30) Foreign Application Priority Data

Dec. 1, 2008 (CN) ..... 2008 1 0305889

(51) Int. Cl.
*A63H 3/38* (2006.01)

(52) U.S. Cl. ..... 446/392; 446/389

(58) Field of Classification Search ..... 446/289, 446/392, 343, 484, 486; 40/414, 416, 463
See application file for complete search history.

(56) References Cited

U.S. PATENT DOCUMENTS

| | | | | |
|---|---|---|---|---|
| 3,905,130 | A * | 9/1975 | Gordon et al. | 434/271 |
| 4,683,669 | A * | 8/1987 | Greer, Jr. | 40/414 |
| 6,586,859 | B2 * | 7/2003 | Kornbluh et al. | 310/309 |
| 7,485,025 | B2 * | 2/2009 | Schnuckle | 446/392 |
| 7,993,181 | B2 * | 8/2011 | Lee et al. | 446/392 |
| 2001/0036790 | A1 * | 11/2001 | Kornbluh et al. | 446/337 |
| 2004/0106353 | A1 * | 6/2004 | Chang | 446/392 |

* cited by examiner

*Primary Examiner* — Gene Kim
*Assistant Examiner* — Alyssa Hylinski
(74) *Attorney, Agent, or Firm* — Altis Law Group, Inc.

(57) ABSTRACT

A simulated eye capable of being changed between a contracted state and a dilated state. The simulated eye includes a semispherical eyeball having a transparent portion, a inductive coil, and an elastic film. The inductive coil coils around the elastic film, a size of the coil elastic film is changeable when being operationally supplied with electricity. When the inductive coil drives the elastic film, a size of the elastic film is changeable, whereby the simulated eye is changed between the contracted state and the dilated state.

6 Claims, 3 Drawing Sheets

SIMULATED EYE FOR TOY

BACKGROUND

1. Technical Field

The disclosure relates to toys and, more particularly, to a simulated eye for a toy.

2. Description of Related Art

A typical toy replica of an eye has an eyelid that can open and close. Accordingly, other effects are needed to make the eyes more lifelike.

BRIEF DESCRIPTION OF THE DRAWINGS

The components of the drawings are not necessarily drawn to scale, the emphasis instead being placed upon clearly illustrating the principles of the embodiments of the simulated eye. Moreover, in the drawings, like reference numerals designate corresponding parts throughout several views.

DETAILED DESCRIPTION

Figure 1:
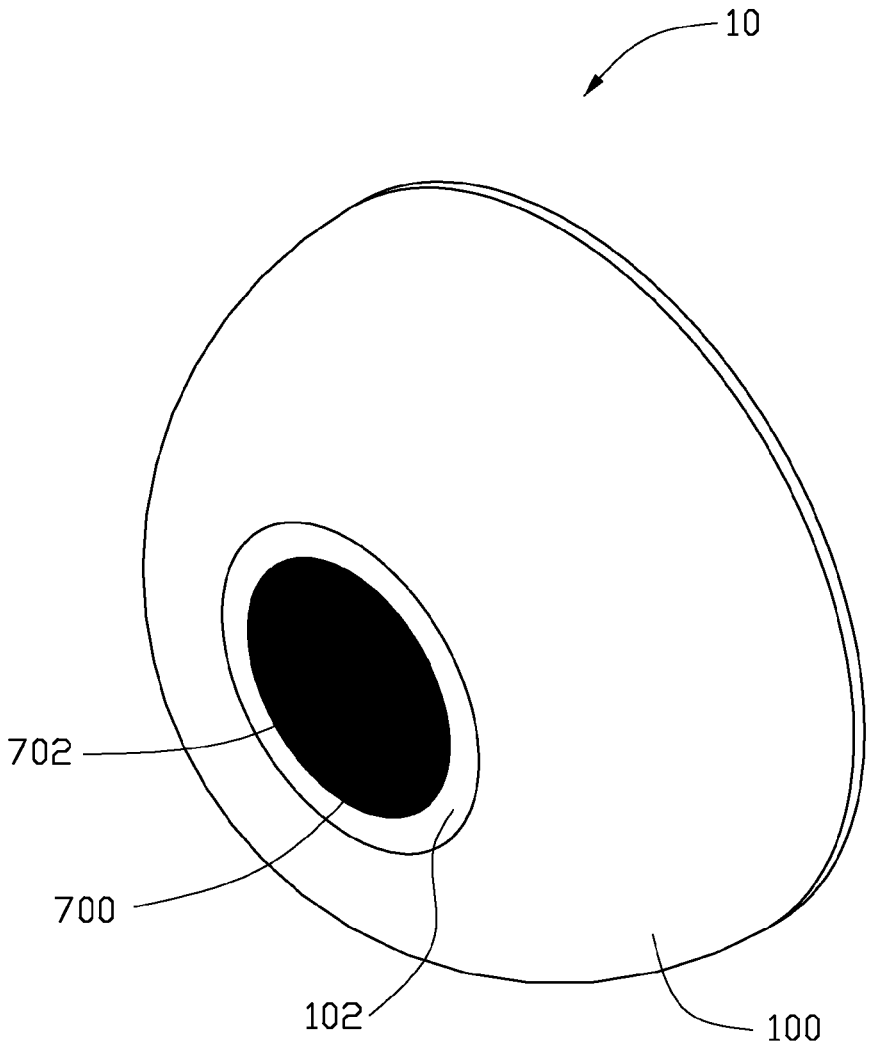
FIG. 1 is a perspective view of a simulated eye in a dilated state in accordance with one embodiment.
Figure 2:
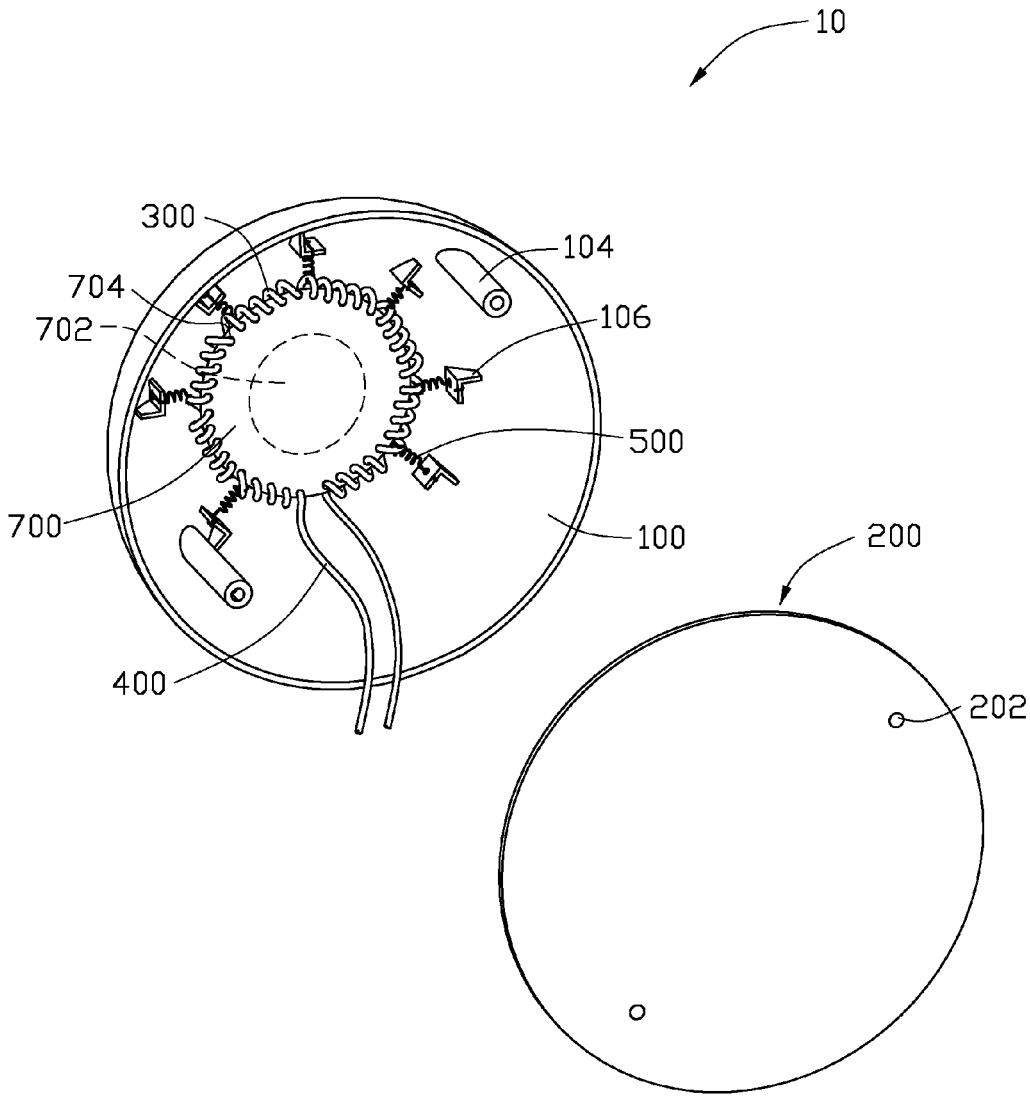
FIG. 2 is a disassembled view of the simulated eye of FIG. 1.

Referring to FIGS. 1 and 2, a simulated eye 10 includes a semispherical eyeball 100, a circular supporting board 200, an inductive coil 300, two wires 400, a plurality of connecting members 500, and a circular elastic film 700. The eyeball 100 is fixed to the supporting board 200, and includes a transparent portion 102 arranged on the front of the eyeball 100. The inductive coil 300 is further electrically connected to a power source (not shown) to conduct electricity via the two wires 400. The elastic film 700 is housed in the eyeball 100 and is visible at the transparent portion 102. The elastic film 700 is elastically coupled to the eyeball 100 via the inductive coil 300 engaging with the plurality of connecting members 500. In detail, the inductive coil 300 coils around the elastic film 700 and is further coupled to an inner surface of the eyeball 100 via the connecting members 500.

Two protruding posts 104 protrude inwardly from an inner surface of the eyeball 100. Each protruding post 104 defines a threaded hole 105. A plurality of protrusions 106 also protrude from the inner surface of the eyeball 100 and are arranged symmetrically in a circle around the elastic film 700. The plurality of connecting members 500 are fixed to the plurality of protrusions 106 correspondingly.

Two round holes 202 are defined in the supporting board 200 and correspond to the two protruding posts 104. Two fixing members (not shown), such as bolts, extend through the round holes 202 to fix the eyeball 100 to the supporting board 200.

A circular portion 702 is arranged at the middle of the elastic film 700 for simulating a pupil. An annular portion of the elastic film 700 surrounding the circular portion 702 is for simulating an iris. A color of the circular portion 702 can be darker than that of the annular portion of the elastic film 700. A plurality of through holes 704 are defined in the elastic film 700. The plurality of through holes 704 are adjacent to a rim of the elastic film 700 and are arranged symmetrically. The inductive coil 300 is threaded through the through holes 704 of the elastic film 700 forming a circle of coils along the circumference of the elastic film 700.

The plurality of connecting members 500 are elastic elements such as coil springs. The number of the plurality of connecting members 500 is equal to that of the protrusions 106. The distance of two opposite protrusions 106 aligned in a diameter of the elastic film 700 is longer than the sum of two lengths of the connecting members 500 and the diameter of the elastic film 700 when the connecting members 500 and the elastic film 700 are not elastically deformed.

In assembly, the inductive coil 300 is coiled around the elastic film 700, and engages with the connecting members 500 which are fixed to respective protrusions 106. The two wires 400 are electrically connected to opposite two ends of the inductive coil 300 respectively to supply electricity thereto from a power source.

After assembly, the elastic film 700 and the inductive coil 300 are substantially coplanar with the protrusions 106. It should be noted that in assembly, because the distance of two opposite protrusions 106 aligned in a diameter of the elastic film 700 is longer than the sum of two lengths of the connecting members 500 and the diameter of the elastic film 700 when the connection member 500 and the elastic film 700 are not deformed, accordingly, the elastic film 700 can be drawn by the connecting member 500 to be enlarged. As a result, the circular portion 702 is enlarged, that is, the simulated eye 10 can be said to be in a dilated state.

Figure 3:
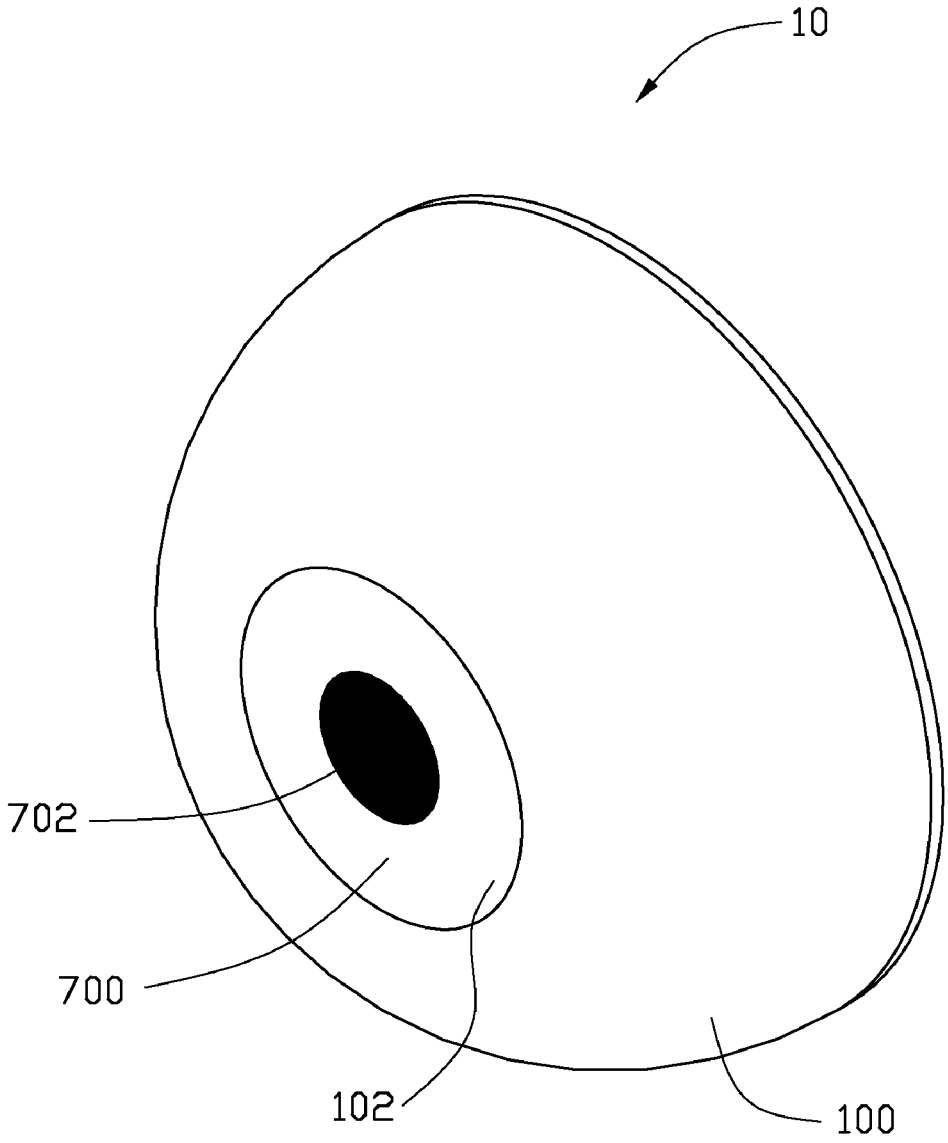
FIG. 3 is a perspective view of the simulated eye of FIG. 1 in a contracted state.

Referring to FIG. 3, when the power source is turned on to supply electricity to the inductive coil 300, a radial force (not shown) pointing toward the center of the elastic film 700 is generated by the inductive coil 300. Accordingly, the inductive coil 300 contracts toward the center of the elastic film 700. Accordingly, the connecting members 500 are pulled by the inductive coil 300 to elastically deform to store elastic energy, and the elastic film 700 contracts. As a result, the size of the circular portion 702 is reduced, and the simulated eye 10 seems to be in a contracted state.

When the inductive coil 300 is powered down, the connecting members 500 release the elastic energy to drive the elastic film 700 to be in a dilated state. As a result, the circular portion 702 is enlarged, and the simulated eye 10 is changed from the contracted state to the dilated state.

Therefore, by operationally supplying electricity to the inductive coil 300 to change the size of the elastic film 700, the simulated eye 10 is changeable between a dilated state and a contracted state.

In other embodiments, the inductive coil 300 can be replaced with electro-magnetic elements arranged to duplicate that expanding and contracting movements of the inductive coil 300.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. A simulated eye, comprising:

an eyeball comprising a transparent portion;

a circular elastic film comprising a circular portion, wherein the circular portion is visible at the transparent portion and is for simulating a pupil;

an inductive coil coiling around the circular elastic film and capable of contracting when being supplied with electric power;

a plurality of protrusions protruding inwardly from the eyeball and arranged symmetrically in a circle; and a plurality of elastic elements, each elastic element corresponding to a protrusion, wherein the circular elastic film is surrounded by the circle formed by the plurality of protrusions and elastically coupled to the eyeball via the inductive coil that is connected to the plurality of protrusions through the plurality of elastic elements, and a distance between two opposite protrusions aligned in a diameter of the circular elastic film is longer than a sum of two lengths of an elastic element and the diameter of the circular elastic film when the elastic element and the circular elastic film are not elastically deformed;

wherein when the inductive coil is powered down, the circular elastic film is stretched by the plurality of elastic elements, and a size of the circular portion is in a dilated state; and when the inductive coil is supplied with electric power, a radial force pointing toward a center of the circular portion generated by the inductive coil pulls the plurality of elastic elements, and the size of the circular portion is contracted.

2. The simulated eye of claim 1, wherein a plurality of through holes are arranged symmetrically in the circular elastic film and are adjacent to a rim thereof, and the inductive coil coils around the circular elastic film by extending through the plurality of through holes.

3. The simulated eye of claim 1, wherein the circular portion is arranged at a middle of the circular elastic film, and a color of the circular portion is darker than a color of an annular portion surrounding the circular portion.

4. The simulated eye of claim 1, further comprising two wires, and the two wires are electrically connected to opposite ends of the inductive coil respectively to supply electricity thereto from a power source.

5. The simulated eye of claim 2, further comprising a circular supporting board, wherein the eyeball is semispherical to be fixed to the supporting board.

6. The simulated eye of claim 2, wherein after the simulated eye is assembled, the circular elastic film and the inductive coil are substantially coplanar with the plurality of protrusions.

* * * * *